US010184721B2

(12) United States Patent
Shea

(10) Patent No.: US 10,184,721 B2
(45) Date of Patent: Jan. 22, 2019

(54) THERMOPLASTIC KETTLE AUXILIARY HEAT EXCHANGER SYSTEM

(71) Applicant: James P. Shea, Waterford, MI (US)

(72) Inventor: James P. Shea, Waterford, MI (US)

( * ) Notice: Subject to any disclaimer, the term of this patent is extended or adjusted under 35 U.S.C. 154(b) by 105 days.

(21) Appl. No.: 15/424,455

(22) Filed: Feb. 3, 2017

(65) Prior Publication Data

US 2017/0227289 A1 Aug. 10, 2017

Related U.S. Application Data

(60) Provisional application No. 62/291,309, filed on Feb. 4, 2016.

(51) Int. Cl.

| | |
|---|---|
| ***F27B 3/20*** | (2006.01) |
| ***F27D 27/00*** | (2010.01) |
| ***F27B 17/00*** | (2006.01) |
| *F27D 99/00* | (2010.01) |

(52) U.S. Cl.

CPC ..... *F27B 3/20* (2013.01); *F27B 17/00* (2013.01); *F27D 27/00* (2013.01); *F27D 2099/006* (2013.01)

(58) Field of Classification Search

CPC ..... B29B 13/022
USPC ..... 126/343.5 A
See application file for complete search history.

(56) References Cited

U.S. PATENT DOCUMENTS 2,389,570 A * 11/1945 Wells et al. ..... C10C 3/002 208/41
2,439,367 A * 4/1948 Middlestadt ..... C10C 3/12 126/343.5 A
2,778,922 A * 1/1957 Birkner, Jr. ..... B01F 7/247 126/343.5 A
3,554,449 A * 1/1971 Currie ..... C10C 3/12 118/302
4,161,391 A * 7/1979 Parker ..... D01D 1/04 126/343.5 A
4,262,820 A * 4/1981 Flint ..... B05C 17/0055 126/231
5,061,170 A * 10/1991 Allen ..... B29B 13/022 425/197

* cited by examiner

*Primary Examiner* — Avinash Savani
(74) *Attorney, Agent, or Firm* — Brinks Gilson & Lione

(57) ABSTRACT

An auxiliary heat exchanger that is used in conjunction with thermoplastic melter kettles. The auxiliary heat exchanger receives molten thermoplastic material from the bottom of a melter kettle, transports the molten thermoplastic material though the auxiliary heat exchanger and feeds the molten thermoplastic material into the top of the melter kettle thereby mixing hotter molten thermoplastic material from the bottom of the melter kettle into cooler thermoplastic material near the top of the melter kettle. The auxiliary heat exchanger includes an oil bath chamber and parallel heat transfer tubes that are arranged in a serpentine configuration and include motor drive augers to transport molten thermoplastic material through the auxiliary heat exchanger.

17 Claims, 14 Drawing Sheets

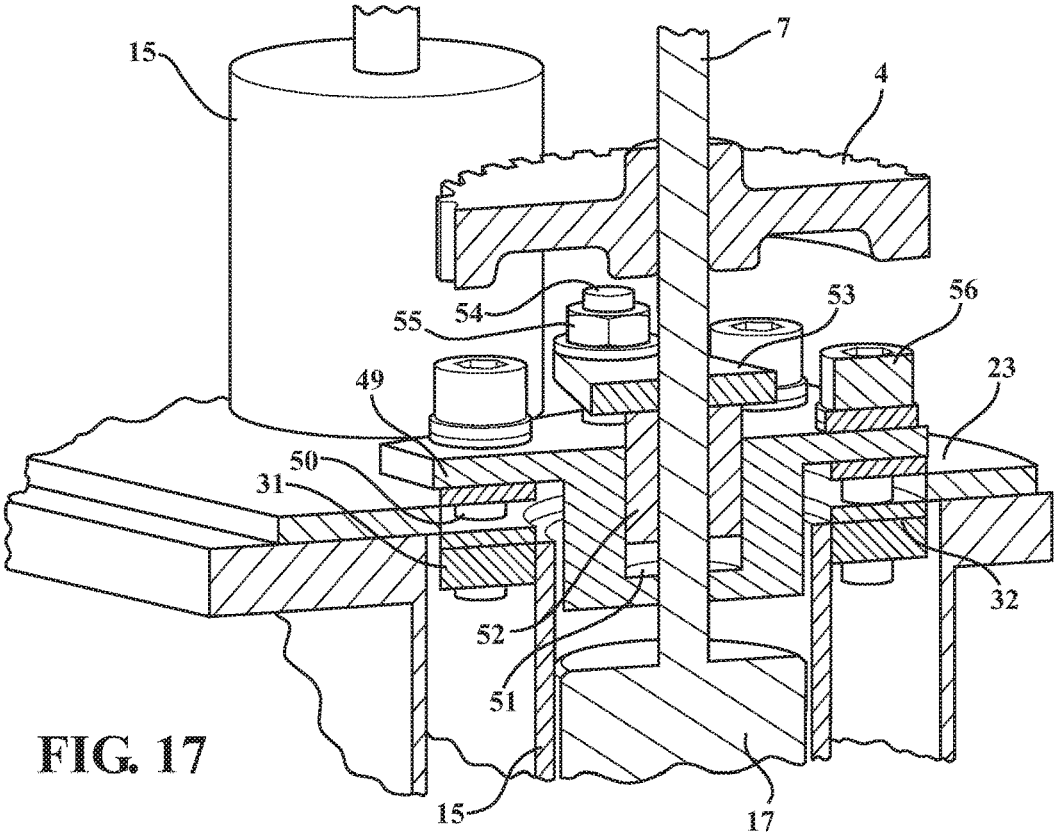
FIG. 17
FIG. 18
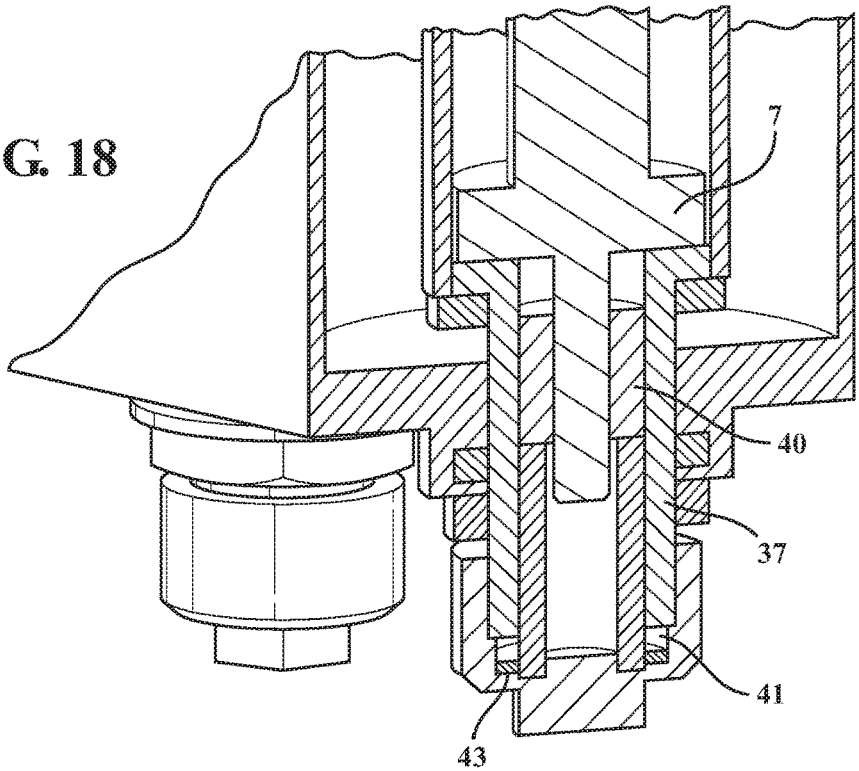

FIG. 23A
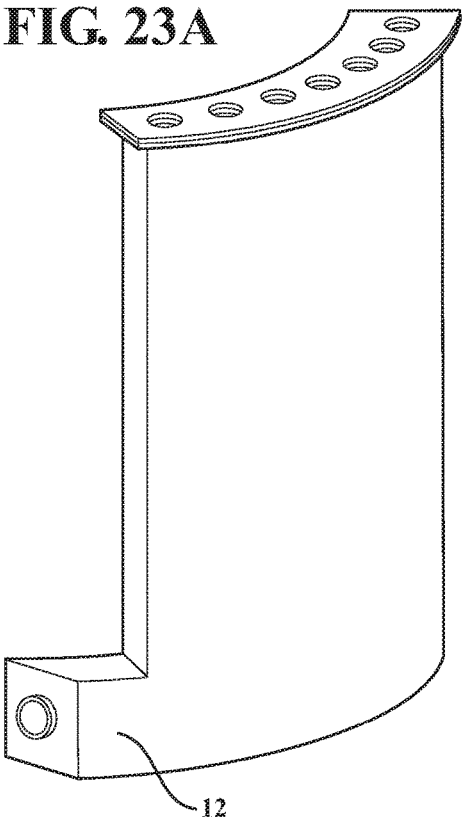
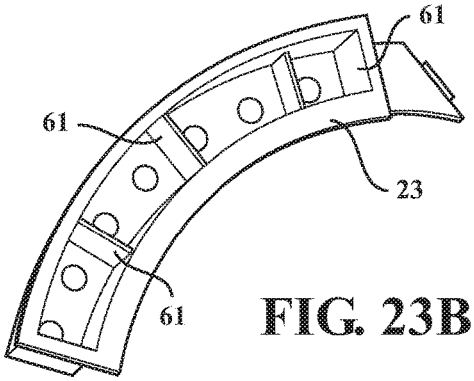
FIG. 23B
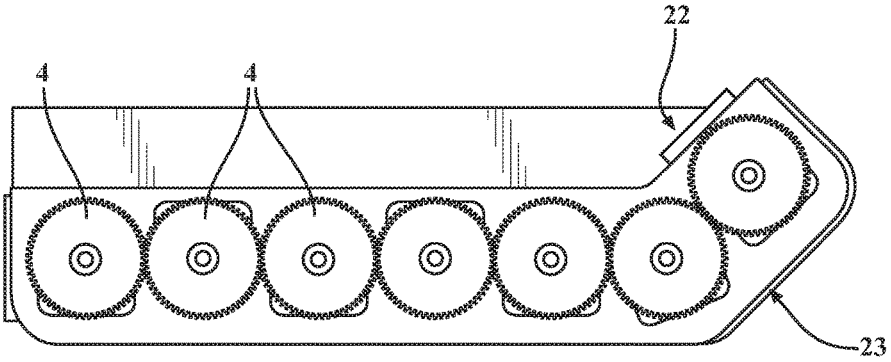
FIG. 24B

THERMOPLASTIC KETTLE AUXILIARY HEAT EXCHANGER SYSTEM

RELATED APPLICATION

The present application is based upon U.S. Provisional Application Ser. No. 62/291,309, filed Feb. 4, 2016 to which priority is claimed under 35 U.S.C. § 120 and of which the entire specification is hereby expressly incorporated by reference.

BACKGROUND

The present invention relates generally to melter kettles that are designed and used to melt thermoplastic materials that are applied to pavements such as roadways, airport runways, parking lots, bicycle paths and other surfaces requiring pavement markings. More particularly the present invention is directed to systems and methods to improving the melting efficiency of melter kettles.

A variety of thermoplastic materials and compositions have been developed and used in the roadway striping industry. In order to apply such thermoplastic materials and compositions, they have to be melted and mixed. Melting, which involves both initial melting from solid stock or feed materials and maintaining the materials/compositions in a molten state for application onto roadways and other pavements, is typically conducted in melter kettles (also referred to herein as "melting kettles") which can be heated by electrical means, or by burning combustible fuels.

Thermoplastic materials/compositions are the current products of choice for many types of marking applications. However, unlike most other types of marking materials thermoplastic materials/compositions must be melted for use. Thermoplastic materials/compositions can be applied by various methods such as spraying, extruding, and screeding. In order to be applied to pavement surfaces the thermoplastic materials/compositions need to be melted and heated to a sufficiently high temperature so as to adjust their viscosity as needed for a particular type of application process. In addition the temperature has to be controlled to avoid scorching.

Thermoplastic materials/compositions must be melted to very high temperatures that can reach up to 400° F. in order to be fluid enough to be applied using current pavement marking equipment. Early types of thermoplastic application equipment applied thermoplastic at slow rates. Therefore, long thermoplastic melting times required in the past to melt thermoplastic materials/compositions in melter kettles was not a problem. Melter kettles could keep up with low output application equipment.

Over time improvements in melter kettle designs were developed which reduced melting times. Eventually improvements in application equipment were developed which enabled thermoplastic materials to be applied at much faster rates. Soon it was recognized that the rate of melting thermoplastic in kettles was not keeping up with improvements in application equipment that increased the rate at which the thermoplastic material can be applied. While methods of application and equipment development have increased, the rate of application production melting capacity has lagged far behind the ability to apply the material.

For some time heat domes, also called heat risers or heat tubes, have been installed in melter kettles. A heat dome is formed by attaching a tube of variable diameter to a hole in the base of a kettle where the OD of the dome base matches the ID of the hole in the base of the kettle. The top of the dome is closed by a metal disc. The dome reduces the heating surface area of the base of the kettle; however, the dome provides additional circumference surface area that compensates for the loss of the heating area in a melter kettle with no dome within a few inches of dome height. Heat domes increase the heated surface area of melter kettles that is in contact with thermoplastic materials as compared to melter kettles that do not have heat domes thereby increasing the heat transfer into the thermoplastic materials in the kettle. This increases the ratio of heat transfer area to thermoplastic volume which improves heating efficiency.

An additional advantage of heat domes is that they provide for heating thermoplastic materials from the center of a melter kettle. Heating thermoplastic material in a melter kettle from the center of the kettle in an outwardly direction is more efficient than heat transfer from the outside of the kettle in an inward direction.

The use of heat domes in melter kettles has reduced melting times in kettles. However, heated air in heat domes cools as heat is transferred through the dome wall and top into the thermoplastic material being heated. This phenomenon limits the efficiency of heat domes. While melting times are reduced with the use of domes, further improvement is desirable.

The present inventor has recently developed a heat dome temperature regulating system that improves the melting efficiency of heat domes in melter kettles. The system, the subject matter of a copending patent application, includes a heat dome chimney stack tube that is attached to the top center of the heat dome around which an agitator drive shaft tube rotates. Heat travels from the heat dome up the center of the heat dome chimney stack tube and vents out of a top tube drive shaft heat chamber that is provided with an adjustable venting arrangement. This system exhausts air from the heat dome that has been heat depleted thereby allowing a continual flow of air heated to its maximum efficient temperature into the dome such that the maximum amount of heat is transferred through the heat dome and through the surfaces of the heat dome chimney stack tube into the thermoplastic material in the melter kettle. In this system the heat dome chimney stack tube and rotational drive shaft become heating surfaces that extend through the centerline of the kettle.

The present invention further increases the efficiency of melting thermoplastic materials in melter kettles.

BRIEF SUMMARY

According to various features, characteristics and embodiments of the present invention which will become apparent as the description thereof proceeds, the present invention provides an improvement for melter kettles that are used for melting thermoplastic pavement marking material wherein the melter kettles are provided with a combustion chamber, the improvement comprising an auxiliary heater coupled to the melter kettle, the auxiliary heater comprising an oil bath chamber through which heated oil is circulated and a configuration of heat transfer tubes within the oil bath chamber through which molten thermoplastic material can flow, the configuration of heat transfer tubes is coupled at one end to a lower portion of the melter kettle and coupled at another end to the top of the melter kettle for receiving molten thermoplastic from the lower portion of the melter kettle and discharging molten thermoplastic material to the top of the melter kettle.

The present invention further provides a melter kettle for melting thermoplastic pavement marking material in combination with an auxiliary heater wherein:

the melter kettle comprises a combustion chamber and a heat dome chamber in the bottom of melter kettle; and the auxiliary heater comprises an oil bath chamber through which heated oil is circulated and a configuration of heat transfer tubes within the oil bath chamber through which molten thermoplastic material can flow, the configuration of heat transfer tubes is coupled at one end to a lower portion of the melter kettle and coupled at another end to the top of the melter kettle for receiving molten thermoplastic from the lower portion of the melter kettle and discharging molten thermoplastic material to the top of the melter kettle.

The present invention also provides a method of melting a thermoplastic material in a melter kettle having a combustion chamber, the method comprising:

charging thermoplastic material into the melter kettle;

combusting a fuel source in the combustion chamber to heat and melt the thermoplastic material in the melter kettle;

providing an auxiliary heater;

transporting molten thermoplastic material from the bottom of the melter kettle through the auxiliary heater and then into the top of the melter kettle.

BRIEF DESCRIPTION OF THE DRAWINGS

The present invention will be described with reference to the attached drawings which are given as non-limiting examples only, in which:

FIG. 11 is a view of an oil bath chamber according to one embodiment of the present invention with a top mounting plate there on.

FIG. 17 is a view of the upper interface showing the components in the top of the tube assembly according to one embodiment of the present invention.

FIG. 18 is a view of the lower interface showing the components in the bottom of the tube assembly according to one embodiment of the present invention.

FIG. 23A is a view of an oil bath chamber according to one embodiment of the present invention.

FIG. 23B is a bottom view of the top mounting plate which depicts an arrangement of the heat fluid flow channelization fins of FIG. 22.

FIG. 24B is a top view of the auxiliary heat exchanger of FIG. 24A.

DETAILED DESCRIPTION OF THE DRAWINGS AND THE PRESENTLY PREFERRED EMBODIMENTS

Figure 1:
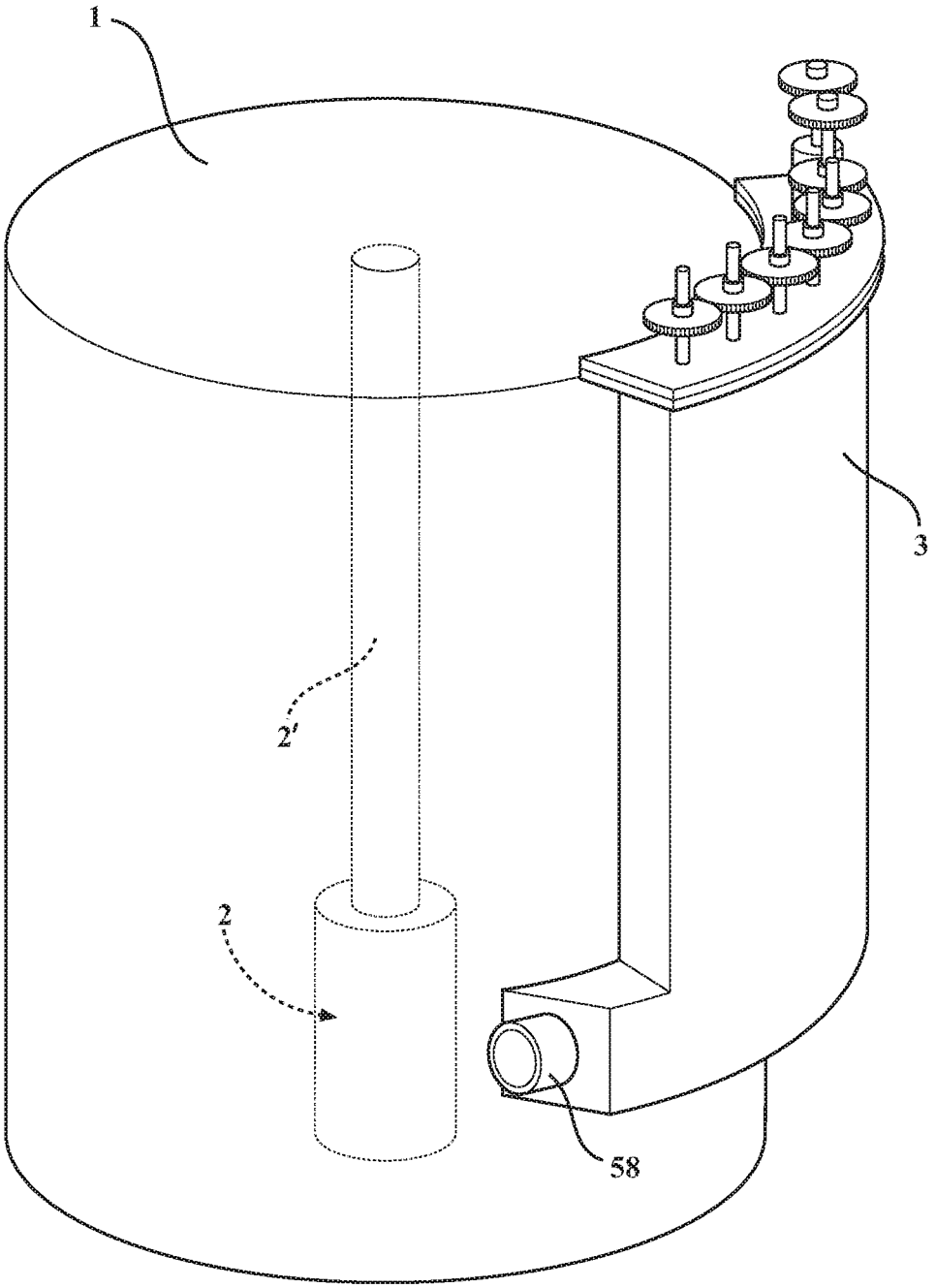
FIG. 1 a perspective view of a heat exchanger attached to the side of a thermoplastic kettle with a dome according to one embodiment of the present invention.

The present invention provides systems and methods that improve the melting efficiency of melter kettles, including auxiliary heaters that comprise heat exchangers. The present invention is applicable to melter kettles having heat domes and melter kettles that do not have heat domes. The systems and methods of the present invention reduce the melting time of thermoplastic pavement marking materials that are melted in thermoplastic melter kettles. The melter kettles can be stationary, mounted on support trucks, support trailers or on truck mounted thermoplastic application vehicles where the vehicle includes an applicator for marking pavements with the thermoplastic material.

The present invention is based partially on the recognition that material melts at a faster rate at the bottom of a melter kettle, that there is a temperature gradient between the base and sides, and that there is a temperature gradient from the bottom of the sides to the top of the sides. In addition the present invention takes advantage of the fact that material in a kettle melts most efficiently at the bottom and more efficiently from the center of the kettle towards the sides than from the sides towards the center. Therefore, while a standard kettle can be used with this invention, using a kettle with a heat dome and the heat dome temperature regulation system described in the inventor's copending application provides a rate of melting that will be greatly improved.

The present invention increases the rate of melting in two novel ways. First the rate of heating will be increased when the thermoplastic material reaches a viscosity where it will enter the auxiliary heat exchanger intake at the base of the kettle where the material is hottest and be able to move through the heat transfer tubes by action of counter rotating augers to the top of the last heat transfer tube's outlet where it is deposited onto and mixed by action of agitators with the cooler thermoplastic material at the top of the kettle. When a heat dome and chimney stack tube are included they greatly increase the rate of heating in the base of the kettle such that the material being introduced at the top of the kettle transfers more heat to the material at the top of the kettle thereby reducing melting time as compared to a melter kettle without a heat dome.

The second novel aspect of this invention is based upon the principal of heat exchange. The action of heating material by moving material from the bottom of the kettle to the top of the kettle where material is added and therefore coolest is passive. The heat exchange system is a dynamic system whereby heat transfer oil is heated to a temperature above that of the temperature required to apply thermoplastic during a pavement marking process and is circulated through an oil bath chamber that encases a series of a variable number of interconnected heat transfer tubes through which the thermoplastic material flows by action of counter rotating augers. Heat is transferred from the hot oil through the heat transfer tube walls and into the thermoplastic material. The addition and use of this system in conjunction with a thermoplastic melter kettle makes it now possible to keep up with the rate of application of thermoplastic from high output application equipment.

FIG. 1 a perspective view of a heat exchanger attached to the side of a thermoplastic kettle with a dome according to one embodiment of the present invention. The thermoplastic melter kettle 1 can be heated from a conventional combustion chamber (not shown) located under the base of the kettle 1. The kettle has a dome 2 and can include a heat dome chimney stack tube 2' that vents hot gases out the top of the melter kettle 1 to greatly increase the heating efficiency of the kettle. Attached to the side of the kettle 1 is an auxiliary heat exchanger 3 described in more detail below. As shown the auxiliary heat exchanger has an arcuate shape that in designed to be compatible with cylindrical melter kettles. In alternative embodiment the auxiliary heat exchanger can have other shapes as desired to be compatible with and be mounted aside of a melter kettle. Even non-curved shapes can be used in some embodiments.

Figure 2:
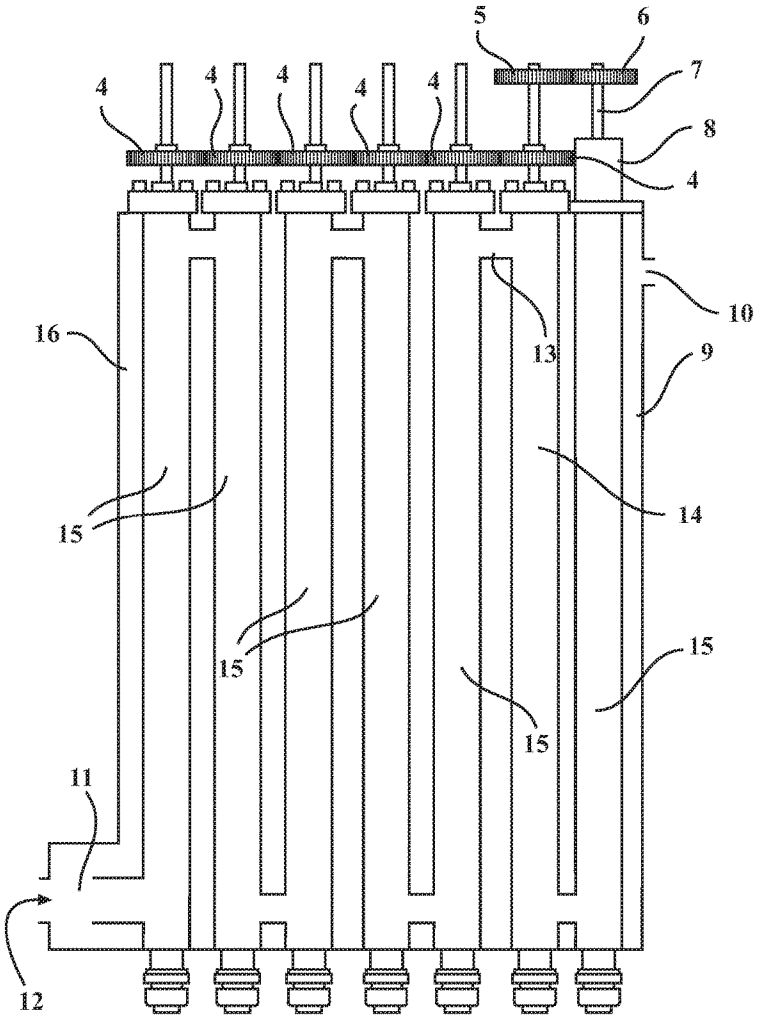
FIG. 2 is front view of the heat exchanger of FIG. 1.

FIG. 2 is front view of the heat exchanger 3 of FIG. 1. The heat exchanger in FIG. 2 does not include the front face 9 of the oil bath chamber 48 of FIG. 10 so as to allow a view of the arrangement of the heat transfer tubes 15 which are depicted as having equal lengths. While the heat exchanger 3 in FIG. 2 is shown as having seven heat transfer tubes, it is to be understood that the number heat transfer tubes 15 can be fewer or more. Discharge heat transfer tube 8 on the outlet side of the heat exchanger 3 is taller than the heat transfer tubes 15 and extends above the top of the kettle 1 to allow for discharge of molten thermoplastic material above the top level of the thermoplastic material contained within the kettle 1.

During use molten thermoplastic material moves through the heat exchanger by rotation of the auger flights 17 that are located in heat transfer tubes 15 and 8 and are attached to the auger drive shafts 7 that are rotated by cooperating gears 4 and elevated gear 5 on the last heat transfer tube 14 that is coupled to the elevated heat transfer tube 8. Inter connecting transfer tubes 13 create a serpentine flow pathway through the heat transfer tubes 15 and 8. Rotation of the auger drive shaft 7 on that extends into heat transfer tube 8 is effected by rotation of elevated gear 5 acting on elevated gear 6 auger drive shaft that extends into heat transfer tube 8.

The flow of plastic through the system is such that material can be moved from the thermoplastic inlet 11 connected to the base of the kettle 1 through the system of inter-connected heat transfer tubes 15 and 8 and into the top of the kettle through the material discharge port 22 at the top of the heat transfer tube 8 (also referred to herein as discharge tube 8). The material flow can also be reversed by reversing the rotation of the gears 4 such that no material is in any of the heat transfer tubes 4 with the exception of the thermoplastic inlet tube 16 (first upstream heat transfer tube 15) where the level of material in the inlet tube 16 will equal the level of the material in the melter kettle 1. Material exits or reenters the kettle 1 through the material inlet port 11. Heat depleted oil is discharged from an oil outlet port 12 and returns to the oil heating system (not shown) and where it is reheated and returned to the oil inlet port 10.

Figure 3:
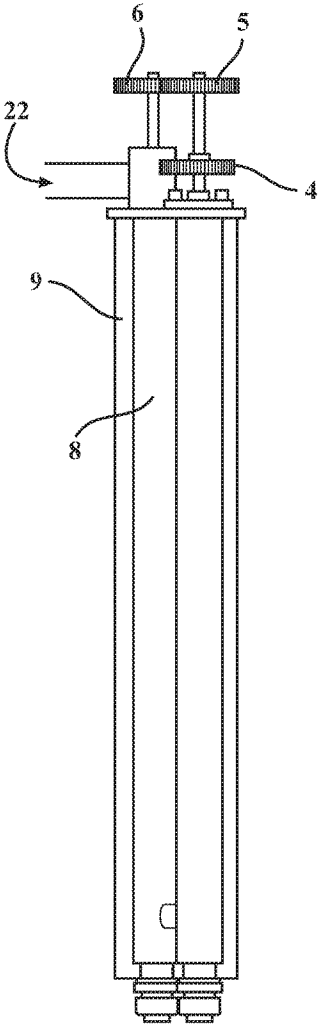
FIG. 3 is a side on view of the heat exchanger of FIGS. 1 and 2 showing a discharge tube and adjacent tube with the oil bath wall and outer skin removed.

FIG. 3 is a side on view of the heat exchanger of FIGS. 1 and 2 showing a discharge tube and adjacent tube with the oil bath wall and outer skin removed. As shown in FIG. 3 the thermoplastic outlet 22 that is located at the top of discharge tube 8 where thermoplastic material transported bidirectionally either into or away from the top of the kettle 1 by rotation direction of gears 4, 5 and 6.

Figure 4:
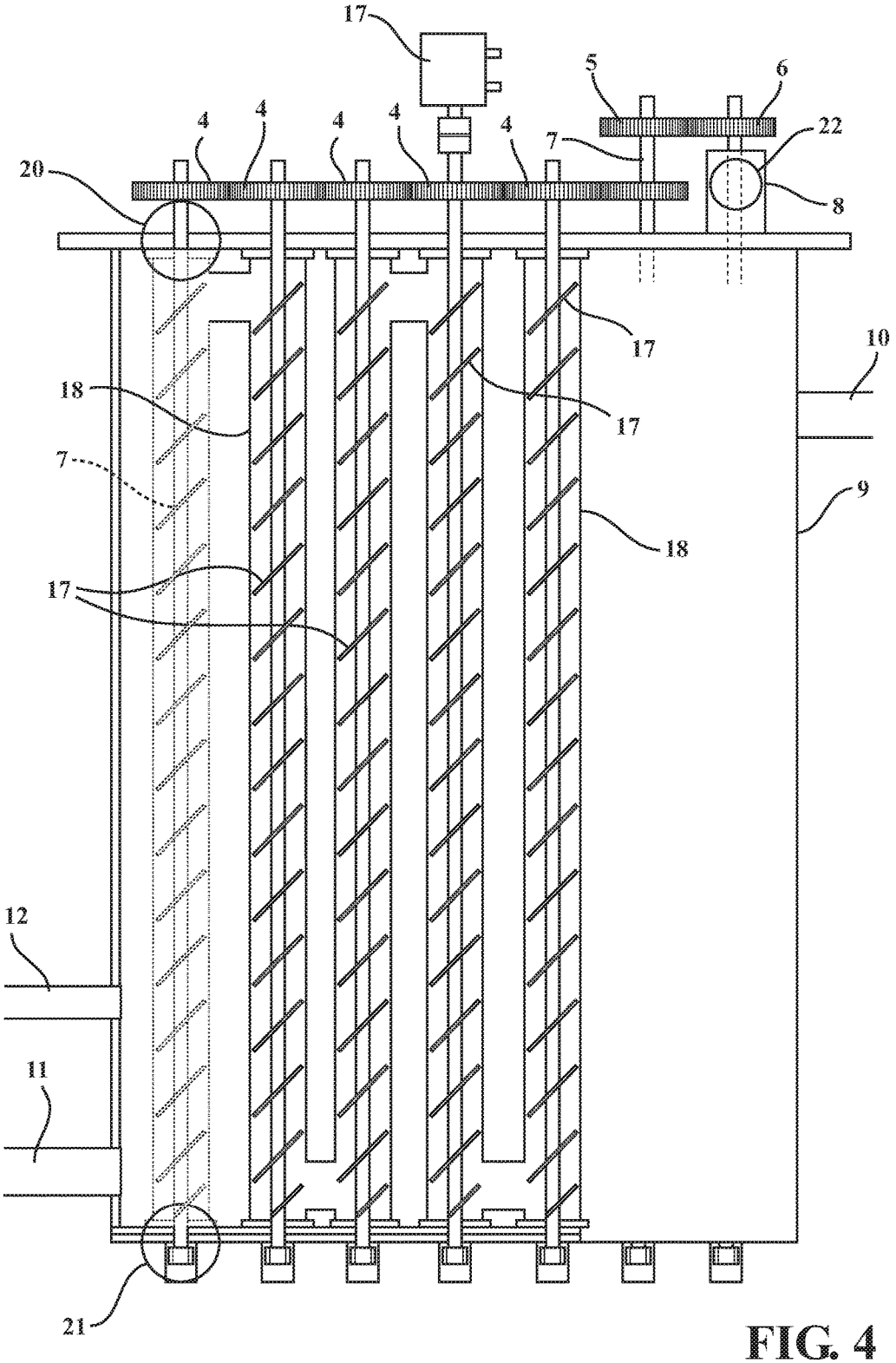
FIG. 4 is a front schematic view of the heat exchanger according to one embodiment of the present invention.

FIG. 4 is a front schematic view of the heat exchanger according to one embodiment of the present invention. FIG. 4 is a front cut away view that shows the oil bath chamber's inlet 10, partial wall 9, and oil bath outlet 12 and the gear train assembly 4, 5, and 6 that rotates the auger drive shafts 7 which in turn are rotated by a reversible motor 17 that can be attached to any of the variable number of auger drive shafts. A speed controlled and reversible motor 17 can be used to allow control of the rate and direction of material flow as desired. As the drive shafts 7 rotate the auger flights 17 in one direction the auger flights move the thermoplastic from the material inlet port 11 through the interconnected tubes 15 where it exits discharge tube 8 through thermoplastic outlet port 22. By reversing the direction of rotation of the motor 17 the direction and rate of material flow through the invention can be regulated.

The top of the heat exchanger tube assembly is connected to a top mounting plate 23 (See FIG. 5) that encloses and seals the top of the oil bath chamber 48 and can be used to attach the heat exchanger to a melter kettle lid (not shown). The heat exchanger has a bottom plate 33 (See FIG. 8) to which the bottom of the tube assembly is attached so as to seal the bottom of the oil bath chamber 48 against leaks with a gasket. In FIG. 4 the circled area 20 showing the upper interface is described in FIG. 17 and the circled area 21 showing the lower interface is described in FIG. 17.

Figure 5:
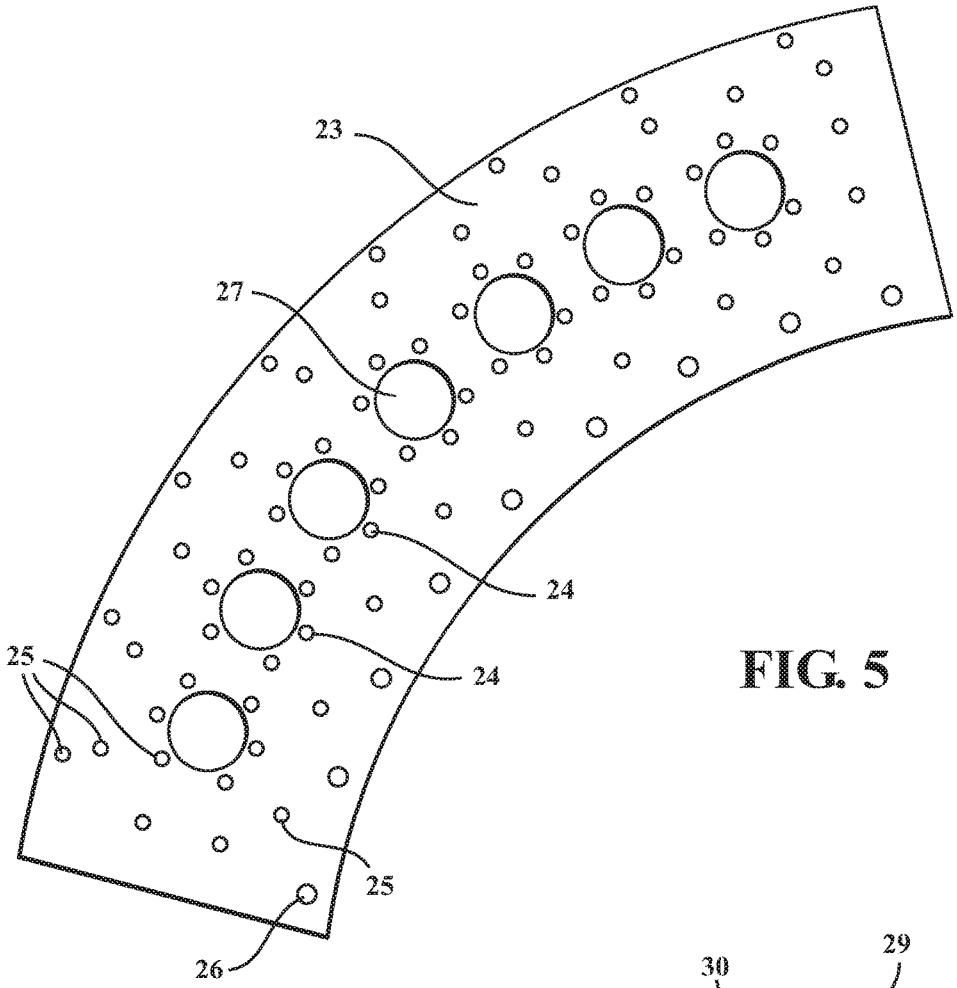
FIG. 5 is a sketch of a top mounting plate of a heat exchanger according to one embodiment of the present invention.

FIG. 5 is a sketch of a top mounting plate of a heat exchanger according to one embodiment of the present invention. The top mounting plate 23 is provided with non-threaded holes 24, 25, 26 and 27 for component mounting through which connecting bolts (not shown) can be inserted. The top mounting plate top flange ports 27 are of a larger ID than the OD of the auger drive shafts 7 and auger flights 17 to allow for independent removal of the auger assemblies from the heat transfer tubes 15 and 8.

Figure 6:
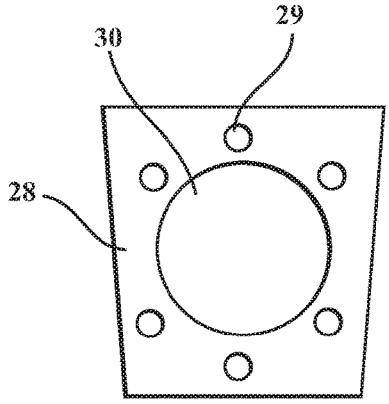
FIG. 6 is a sketch of a gasket that can be used between the top tube flange and top mounting plate of a heat exchanger according to one embodiment of the present invention.

FIG. 6 is a sketch of a gasket that can be used between the top tube flange 31 (FIG. 7) and top mounting plate 23 of a heat exchanger according to one embodiment of the present invention. As shown the gasket 28 has bolt holes 29 which correspond to the holes 24 surrounding the top flange ports 27 for receiving mounting bolts (not shown). The hole 30 in top mounting plate 23 has a diameter that also allows auger drive shafts 7 and auger flights 17 to be removed therethrough.

Figure 7:
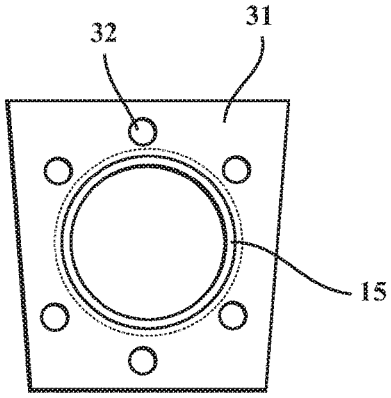
FIG. 7 is a sketch of a top flange and attached tube of a heat exchanger according to one embodiment of the present invention.

FIG. 7 is a sketch of a tube top flange and attached tube of a heat exchanger according to one embodiment of the present invention. The tube top flanges 31 are welded to the tube tops of the heat transfer tubes 15 and 8 and are provided with threaded holes 32 for attachment of the top mounting plate 23 and the upper interface (see FIG. 17).

Figure 8:
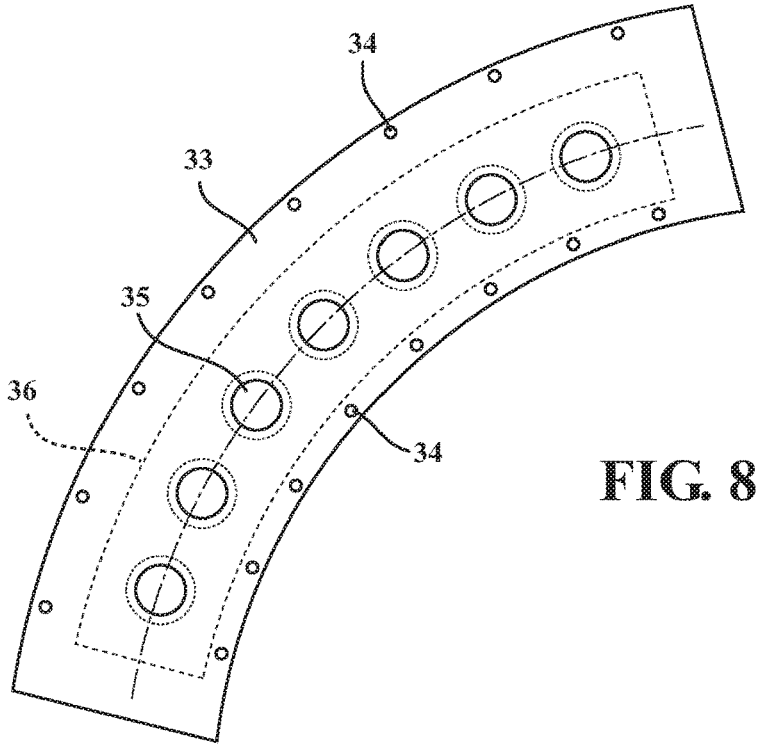
FIG. 8 is a sketch of a bottom mounting plate of a heat exchanger according to one embodiment of the present invention.

FIG. 8 is a sketch of a bottom mounting plate of a heat exchanger according to one embodiment of the present invention. In FIG. 8 is view of the bottom mounting plate 33 from the bottom looking up with holes 34 through which bolts 39 secure the bottom plate 33 to the oil bath chamber. Tapped holes 38 (See FIG. 9) are provided for sandwiching gaskets (not shown) to prevent the bottom of the oil bath outer walls from leaking. Holes 35 are shown through which the bottom bushing tube 37 (See FIG. 9) is welded to the bottom of the heat transfer tube 15 extends. The bottom inner wall of the oil bath 48 is shown by broken lines 36.

Figure 9:
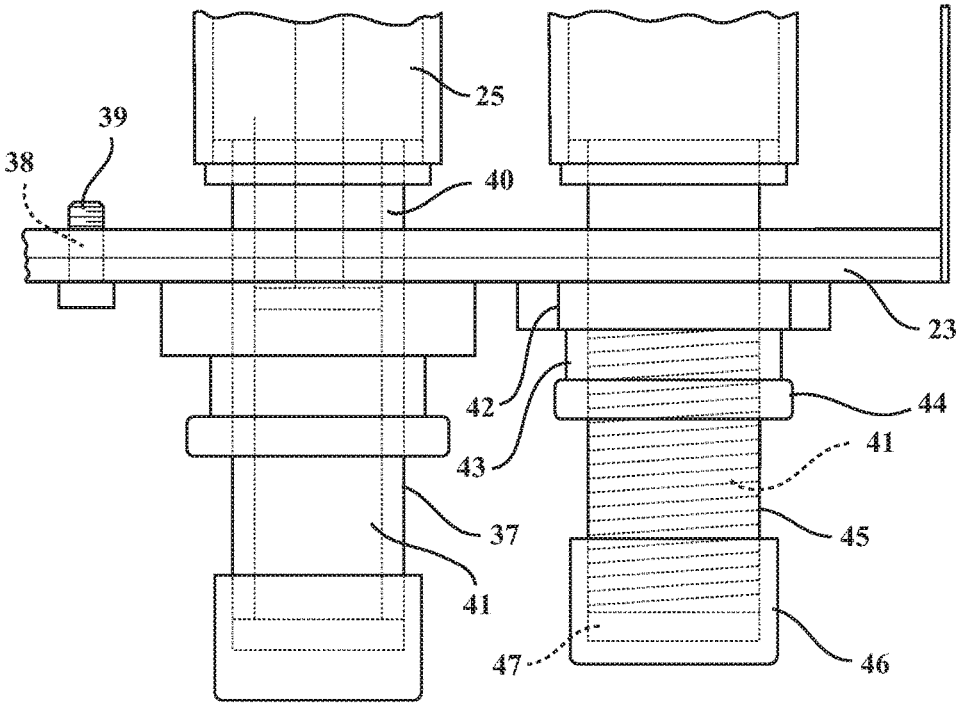
FIG. 9 is a sketch of a leak proof bottom assembly of a heat exchanger according to one embodiment of the present invention.

FIG. 9 is a sketch of a leak proof bottom assembly of a heat exchanger according to one embodiment of the present invention. The bottom of the auger shaft 7 is centered in a bushing 40 that is centered in the bottom bushing tube 37. The bushing tube 37 and auger shaft 7 rest on a solid spacer 41 that keeps the moving parts of the assembly very close to the oil bath bottom such that heat transfer from the oil bath 48 liquefies the thermoplastic around the bottom of the auger shaft 7 allowing it to rotate freely in a shorter amount of time than if the auger shaft assembly extended down and out of the heated assembly.

The assembly is sealed at the bottom from oil leaks by a gasket 41 that is compressed around the non-threaded portion of the bottom bushing tube 37 by the action of a gasket ram 43 that is forced against the bottom plate 33 by action of a jam nut turning about the threaded portion 45 of the bottom bushing tube 37. Thermoplastic is prevented from leaking from the bottom bushing tube 37 by a gasket 47 against the base of a threaded cap 46 that is screwed on to the threaded end of the bottom bushing tube 37.

Figure 10:
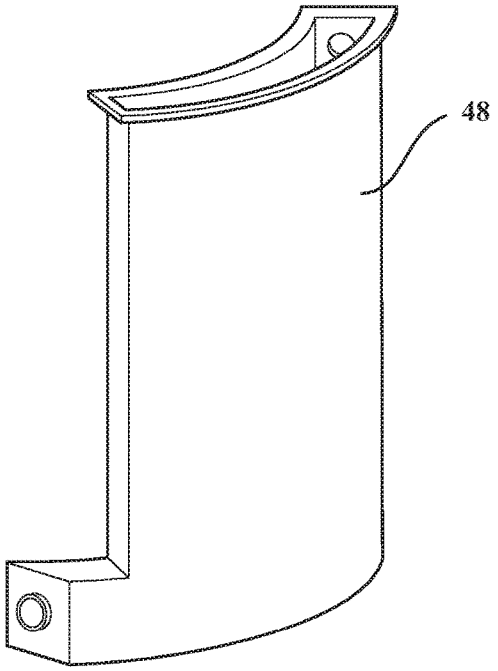
FIG. 10 is a view of an oil bath chamber according to one embodiment of the present invention.

FIG. 10 is a view of an oil bath chamber according to one embodiment of the present invention. The top mounting plate 23 is not included in FIG. 10. The oil intake port 10 and the oil discharge port through which heated oil is supplied to and removed from the oil bath chamber 48 are shown in FIG. 10.

Figure 11:
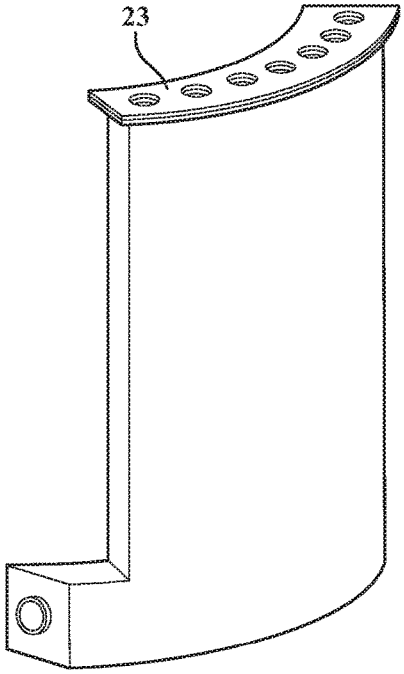

FIG. 11 is a view of an oil bath chamber according to one embodiment of the present invention with a top mounting plate 23 secured there on.

Figure 12:
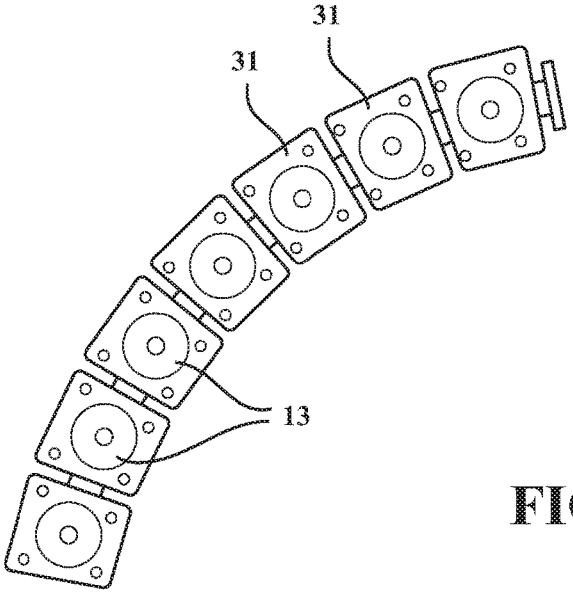
FIG. 12 is a top view of a top flanges with attached tubes with interconnecting tubes according to one embodiment of the present invention.

FIG. 12 is a top view of a top flanges with attached tubes with interconnecting tubes according to one embodiment of the present invention. FIG. 12 shows how the heat transfer tubes 15 are interconnected with transfer tubes 13 and also shows the arrangement of the top flange 31.

Figure 14:
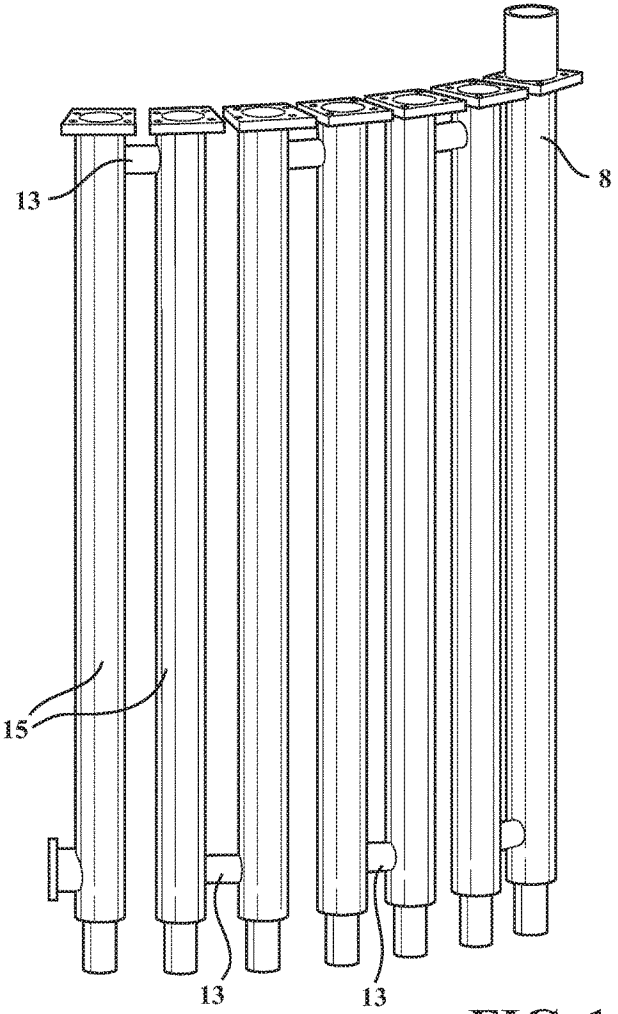
FIG. 14 is an outside in view of the tube assembly of FIG. 13 showing top flanges and thermoplastic inlet according to one embodiment of the present invention.
Figure 13:
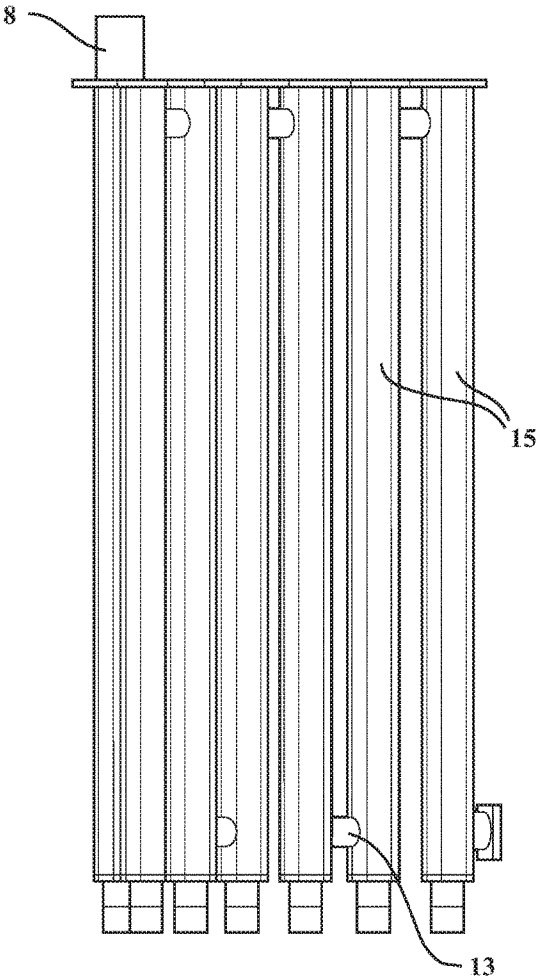
FIG. 13 is an inside out view of the tube assembly of a heat exchanger according to one embodiment of the present invention.

FIG. 13 is an inside out perspective view of the transfer tube assembly and FIG. 14 is an outside in perspective view of the transfer assembly. These figures provide a three-dimensional perspective of the transfer tube assembly that comprises the heat transfer tubes 15 and 8 and transfer tubes 13 which connect between adjacent heat transfer tubes alternatively at opposite top and bottom sides.

Figure 15:
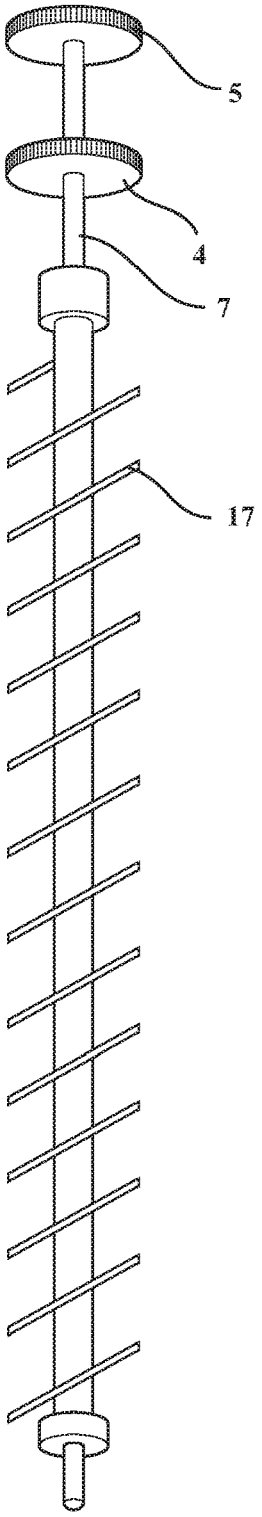
FIG. 15 is a view of the next to the last auger showing the last gear in the gear train and the gear that drives the discharge tube/auger according to one embodiment of the present invention.

FIG. 15 is a view of the next to the last auger showing the last gear in the gear train and the gear that drives the discharge tube/auger according to one embodiment of the present invention. The auger shown in FIG. 15 is made up of auger drive shaft 7 and auger flights 17 that can be counter rotated by action of the standard gears 4 in the gear train and transfer the synchronous rotation to the auger in the discharge tube 8 through the elevated gear 5.

Figure 16:
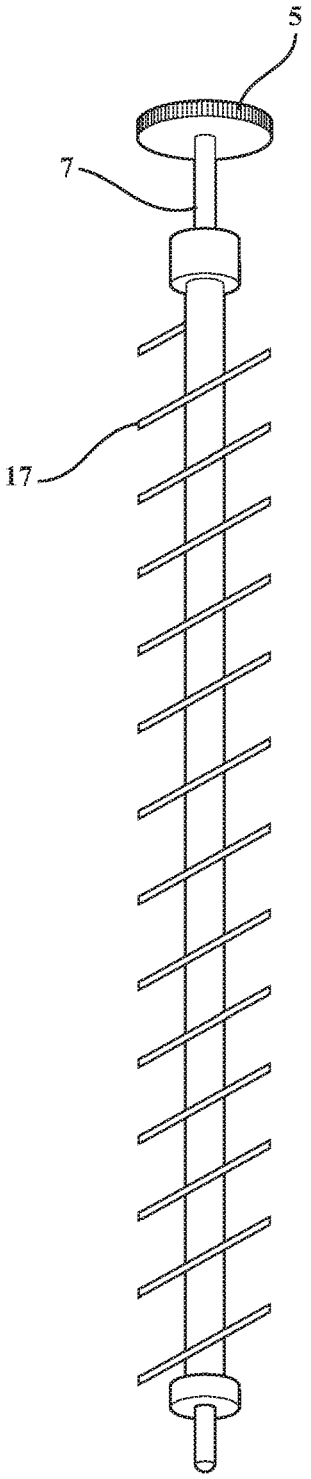
FIG. 16 is a view of the discharge tube/auger with its elevated gear according to one embodiment of the present invention.

FIG. 16 is a view of the discharge tube/auger with its elevated gear according to one embodiment of the present invention. The auger in the discharge tube 8 is provided with a standard but extended drive shaft 7 and auger flights 17 and an elevated gear 5 that allows the auger transport the thermoplastic material above the level of the main body of the heat exchangers and into the top of the kettle (not shown).

FIG. 17 is a view of the upper interface showing the components in the top of the tube assembly according to one embodiment of the present invention. In FIG. 17 drive shaft gear 4 counter-rotates auger drive shaft 7 and drives the auger shaft flights 17 that move thermoplastic material bi-directionally through the heat transfer tubes 15 and 8. A top flange assembly 49 is inserted into the heat transfer tube 15 with gaskets 50 on one side of the top mounting plate 23 that would be in the space between the two gaskets shown between the tube top flange 31 and the top flange assembly 49 (top mounting plate not shown to enable better depiction of other elements). A compression gasket 51 is provided at the interior bottom of the top flange assembly 49. A bronze sleeve bearing 52 is provided under a rectangular bushing ram 53 that has ram studs 54 on either side where jam nuts 55 force the bronze bushing 52 downward thereby compressing the compression gasket 52 against the auger drive shaft 7 creating a seal that prevents thermoplastic from leaking at the top of the invention through the heat transfer tubes 15. Flange attachment bolts 56 hold the upper interface assembly FIG. 17 together as they are tightened with the threaded holes 32 in the tube top flange 31 sandwiching the upper interface together.

FIG. 18 is a perspective view of the lower interface showing the components in the bottom of the tube assembly according to one embodiment of the present invention. As shown in FIG. 18 the bottom of the auger shaft 7 is centered in a bushing 40 that is centered in bushing tube 37. The bushing tube 37 and auger shaft 7 rest on a solid spacer 41 that keeps the moving parts of the assembly very close to the oil bath bottom such that heat transfer from the oil bath 48 liquefies the thermoplastic around the bottom of the auger shaft 7 allowing it to rotate freely in a shorter amount of time than if the auger shaft assembly extended down and out of the heated assembly.

The assembly is sealed at the bottom from oil leaks by a gasket 41 that is compressed around the bottom of bushing tube 37 by the action of a gasket ram 43 that is forced against the bottom plate 33 by action of a jam nut turning about the threaded portion 45 of the bottom bushing tube 37.

Figure 19:
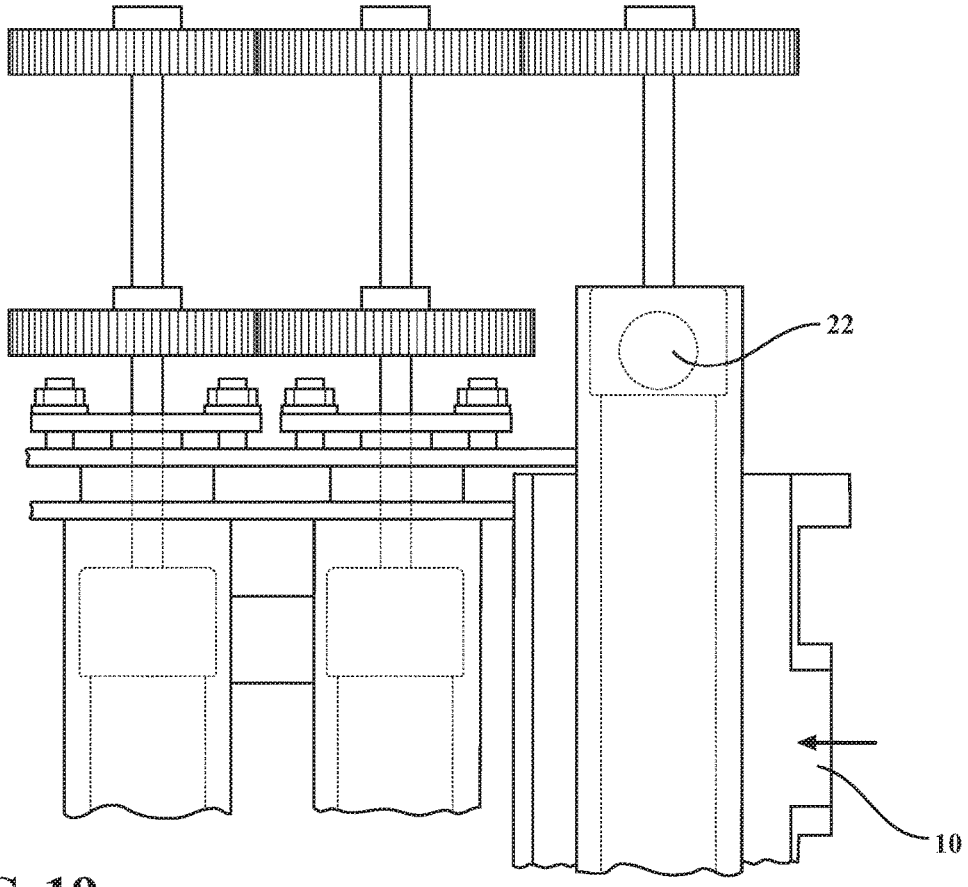
FIG. 19 is a view of the oil inlet of the oil bath chamber and the thermoplastic outlet of the last tube discharging into the top of a kettle according to one embodiment of the present invention.

FIG. 19 is a view of the oil inlet of the oil bath chamber and the thermoplastic outlet of the last tube discharging into the top of a kettle according to one embodiment of the present invention. FIG. 19 depicts the thermoplastic material outlet port 22 of the last and elevated heat transfer tube 8 whereby the thermoplastic material is introduced at the top of the kettle 1 by the action of the extended auger. Also shown is the heat transfer oil inlet 10 of the oil bath chamber 48.

Figure 20:
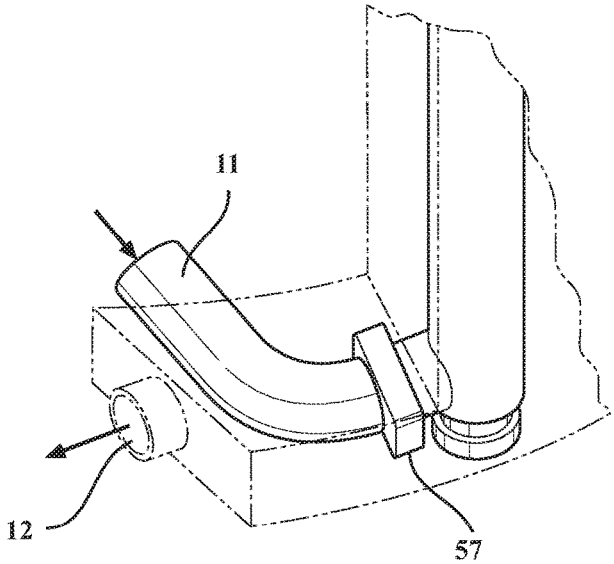
FIG. 20 is a view of the thermoplastic inlet and heating fluid outlet according to one embodiment of the present invention.

FIG. 20 is a view of the thermoplastic inlet and heating fluid outlet according to one embodiment of the present invention. The connection 57 of the thermoplastic inlet tube 11 to the bottom of the first heat transfer tube 15 and the oil bath outlet 12 are shown in FIG. 20. As discussed above, molten thermoplastic material enters the inlet tube 11 from port 58 provided in the base of a melter kettle 1 (See FIG. 1).

Figure 21:
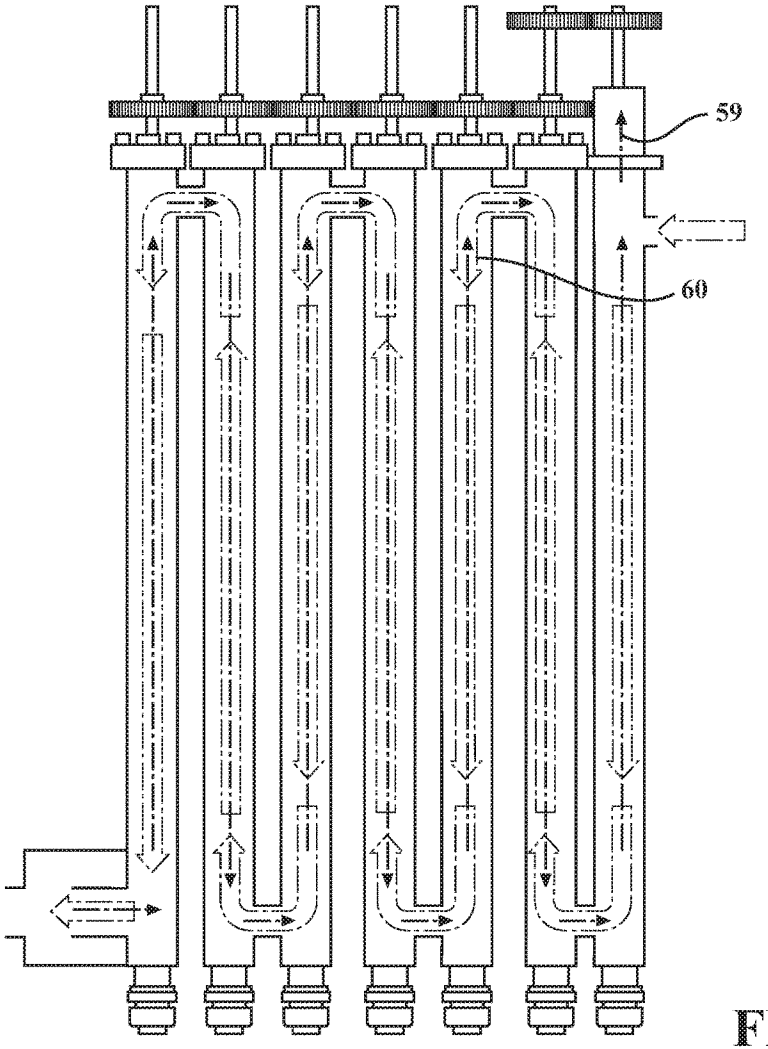
FIG. 21 is a view of the heating fluid flow according to one embodiment of the present invention.

FIG. 21 is a view of the heating fluid flow according to one embodiment of the present invention. The oil bath chamber 48 has not been included in FIG. 21 so that the direction of flow 60 of the heat transfer oil through the invention and the direction of flow 59 of the thermoplastic material through the invention from the kettle 1 bottom material inlet 11 to discharge at the top of the kettle 1 can be depicted more clearly. As discussed above the direction of flow of the thermoplastic material can be reversed and varied by using a reversible, variable speed drive motor 17.

Figure 22:
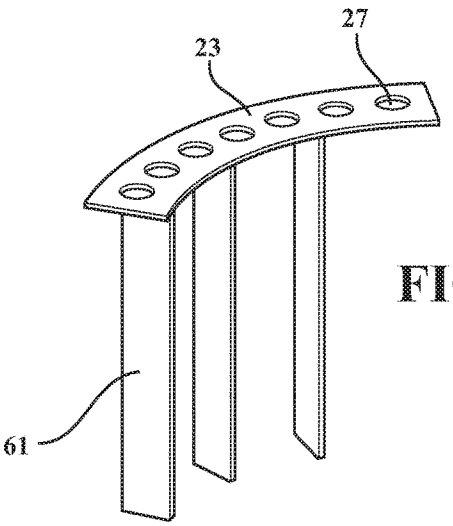
FIG. 22 is a view of the oil bath chamber heating fluid flow channelization fins according to one embodiment of the present invention.

FIG. 22 is a view of the top mounting plate 23 of the oil bath chamber 48 and heating fluid flow channelization fins 61 that are attached to the top mounting plate 23. The channelization fins direct the flow of heat transfer oil though the oil bath chamber 48 so as to maximize heating of thermoplastic material.

FIG. 23B is a bottom view of the top mounting plate 23 which depicts an arrangement of heat fluid flow channelization fins 61 that extend downward from the bottom of the top mounting plate 23 according to one embodiment of the present invention. The mounting plate is at the top of the oil bath chamber shown in FIG. 23A.

Figure 24A:
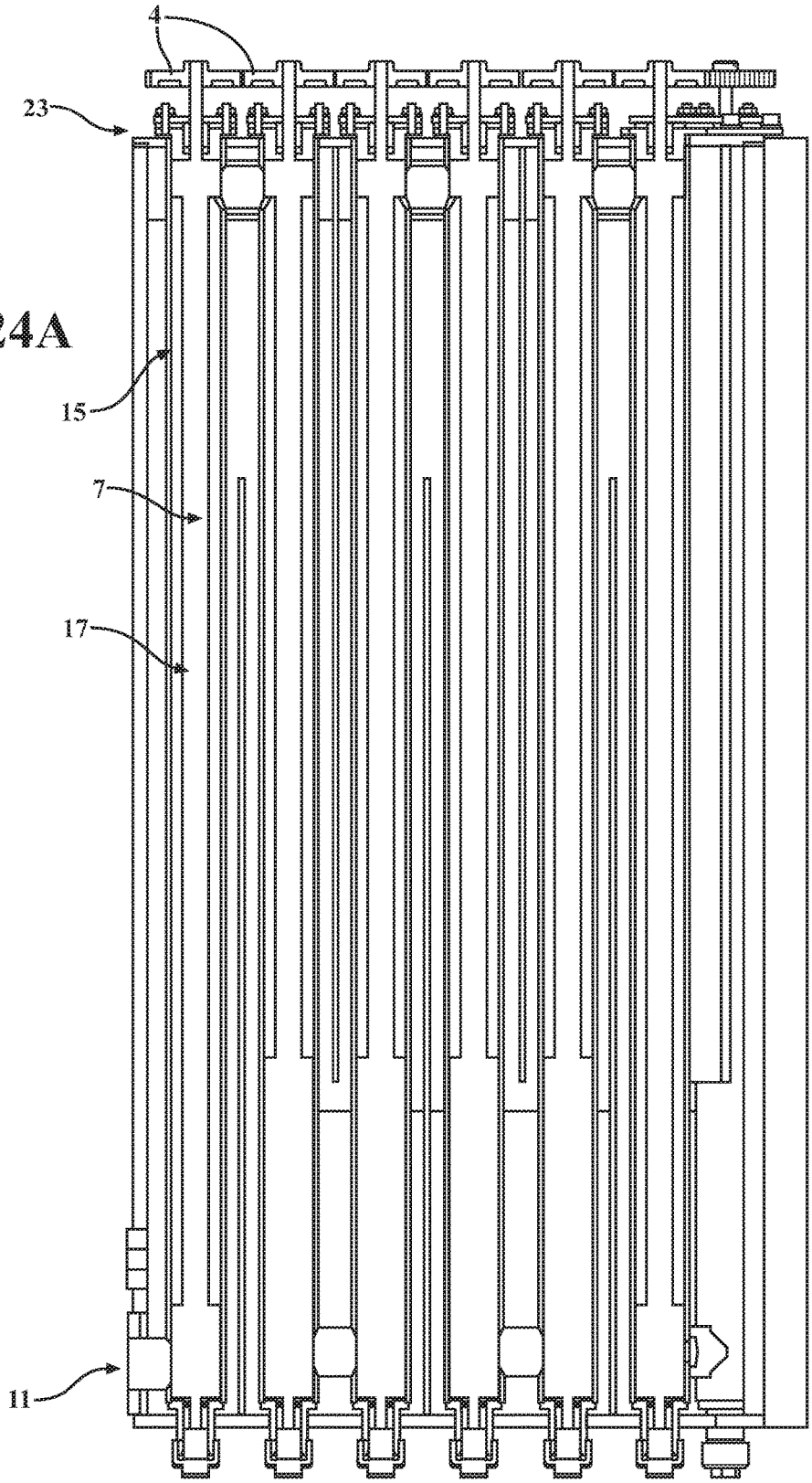
FIG. 24A is a front view of an auxiliary heat exchanger according to another embodiment of the present invention.
Figure 24C:
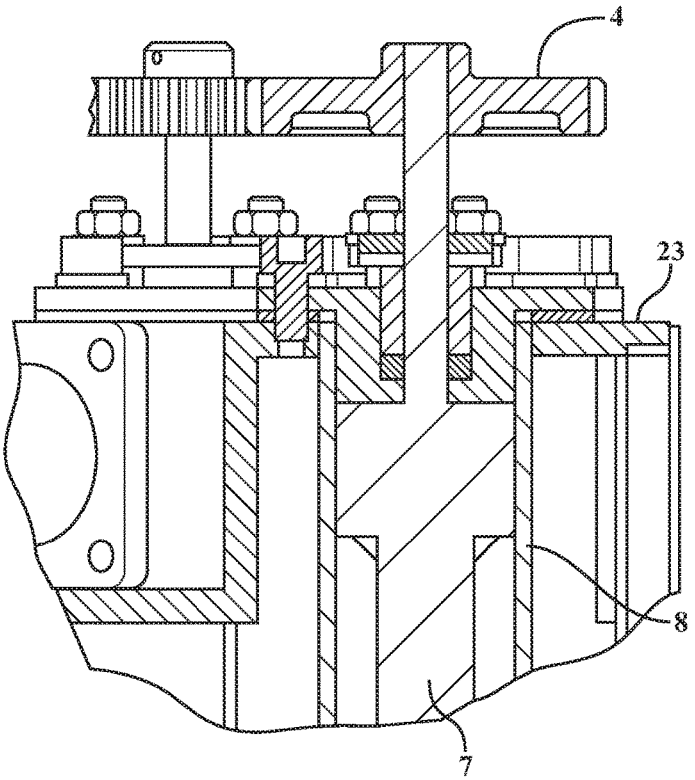
FIG. 24C is a detailed view of a portion of the top of the auxiliary heat exchanger of FIGS. 24A and 24B.
Figure 24D:
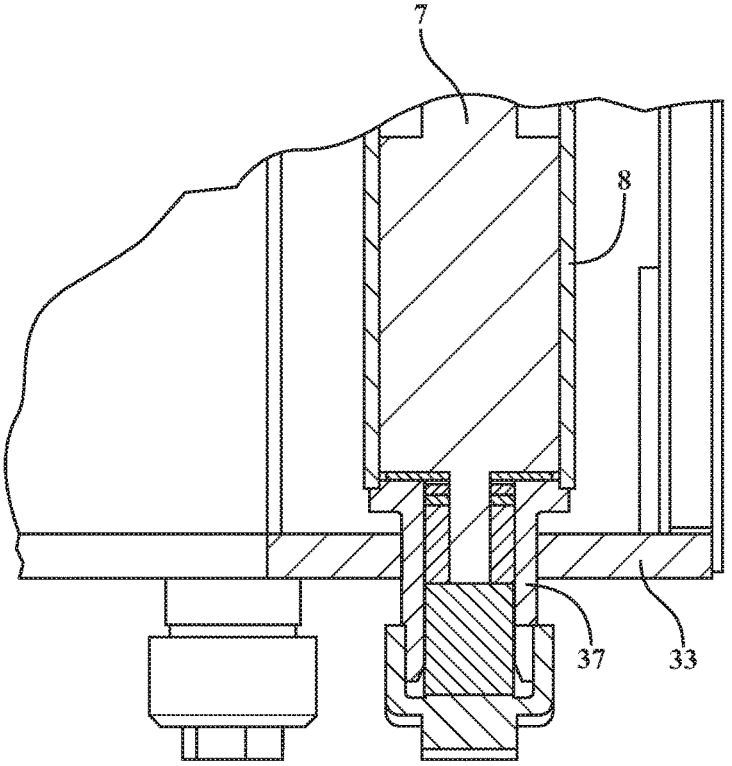
FIG. 24D is a detailed view of a portion of the bottom of the auxiliary heat exchanger of FIGS. 24A and 24B.

FIG. 24A is a front view of an auxiliary heat exchanger according to another embodiment of the present invention. FIG. 24B is a top view of the auxiliary heat exchanger of FIG. 24A. FIG. 24C is a detailed view of a portion of the top of the auxiliary heat exchanger of FIGS. 24A and 24B. FIG. 24D is a detailed view of a portion of the bottom of the auxiliary heat exchanger of FIGS. 24A and 24B.

The auxiliary heat exchanger of FIGS. 24A-24D is configured to be used with and attached to a melter kettle having an octagon shape that can be formed by surrounding a melter kettle with an octagon shaped insulating structure. As can be understood from FIG. 24B the auxiliary heat exchanger 3 flat surface 2 that can be fit against a flat side surface of an octagon shaped melter kettle and a 45° bend portion 2' that can extend against a portion of an adjacent side surface of an octagon shaped melter kettle.

The auxiliary heat exchanger of FIGS. 24A-24D includes essentially all the elements discussed above with reference to FIGS. 1-23. In order to simplify the detailed description of FIGS. 24A-24D only those elements that are unique to FIGS. 24A-24D will be described hereafter, with the understanding that such elements could also be incorporated into the previously described embodiments of the invention. In general the embodiment of the invention of FIGS. 24A-24D simplifies the assembly of the auxiliary heat exchanger by eliminated some of the elements.

The embodiment of the invention shown in FIGS. 24A-24D include similar heat transfer tubes 15 and 8, connecting transfer tubes 13, auger drive shafts 7, auger flights 17, cooperating gears 4, thermoplastic inlet 11 and outlet 22, and hot oil inlet (not shown) and outlet (not shown) as discussed above. Heat transfer tubes 15 are shown as having similar lengths and the configuration of the last heat transfer tube 8 is taller and the gear 4 associated with the last heat transfer tube 8 is depicted as being at the same height as the other gears 4. The configuration of the thermoplastic inlet 11 and outlet 22 can be suitably adapted as desired to supply molten thermoplastic material into the heat transfer tube configuration and to transfer molten thermoplastic material to the top of the melter kettle. Likewise the configuration of the hot oil inlet (not shown) and outlet (not shown) can be suitably adapted to connect to a conventional oil heating system.

FIGS. 24C and 24D depict the main differences between the embodiment of the invention shown in FIG. 24A-24D as compared to the previously described embodiments. In reference to FIG. 24C the tops of heat transfer tubes 15 and 8 are welded to top mounting plate 23, thereby eliminating the top tube flanges 31 and gaskets 28 that are discussed above in reference to FIG. 7. In reference to FIG. 24D the bottom plate 33 is welded to bushing tubes 37, thereby eliminating any gaskets needed to provide a fluid tight seal between the bushing tubes 37 and bottom plate 33.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. In a melter kettle for melting thermoplastic pavement marking material wherein the melter kettle is provided with a combustion chamber the improvement comprising an auxiliary heater coupled outward on an outer side wall of the melter kettle, the auxiliary heater comprising an oil bath chamber through which heated oil is circulated and a configuration of heat transfer tubes within the oil bath chamber through which molten thermoplastic material can flow, the configuration of heat transfer tubes is coupled at one end to a lower portion of the melter kettle and coupled at another end to the top of the melter kettle for receiving molten thermoplastic from the lower portion of the melter kettle and discharging molten thermoplastic material to the top of the melter kettle.

2. The melter kettle of claim 1 further comprising a heat dome chamber in the bottom of melter kettle.

3. The melter kettle of claim 2, further comprising an exhaust gas conduit that is provided between the top of the heat dome chamber and the top of the melter kettle through which exhaust gas conduit combustion gases received in the heat dome chamber can be exhausted from the top of the melter kettle.

4. The melter kettle of claim 1, wherein the configuration of heat transfer tubes includes augers provided within the heat transfer tubes which augers are rotated to transport molten thermoplastic material through the auxiliary heater.

5. The melter kettle of claim 4, wherein the configuration of the heat transfer tubes includes a plurality of parallel heat transfer tubes which are coupled together in a serpentine configuration with the augers having auger drive shafts that extend above the top of the auxiliary heater and cooperating gears on top portions of the auger drive shafts which rotate adjacent augers in opposite directions.

6. The melter kettle of claim 5, further comprising a motor coupled to one of the auger drive shafts to rotate each of the augers.

7. A melter kettle for melting thermoplastic pavement marking material in combination with an auxiliary heater wherein:

the melter kettle comprises a combustion chamber and a heat dome chamber in the bottom of melter kettle; and the auxiliary heater comprises an oil bath chamber through which heated oil is circulated and a configuration of heat transfer tubes within the oil bath chamber through which molten thermoplastic material can flow, the configuration of heat transfer tubes is coupled at one end to a lower portion of the melter kettle and coupled at another end to the top of the melter kettle for receiving molten thermoplastic from the lower portion of the melter kettle and discharging molten thermoplastic material to the top of the melter kettle, said auxiliary heater being coupled outward on an outer side wall of the melter kettle.

8. The combination of a melter kettle and auxiliary heater of claim 7, wherein the configuration of heat transfer tubes includes augers provided within the heat transfer tubes which augers are rotated to transport molten thermoplastic material through the auxiliary heater.

9. The combination of a melter kettle and auxiliary heater of claim 8, wherein the configuration of the heat transfer tubes includes a plurality of parallel heat transfer tubes which are coupled together in a serpentine configuration with the augers having auger drive shafts that extend above the top of the auxiliary heater and cooperating gears on top portions of the auger drive shafts which rotate adjacent augers in opposite directions.

10. The combination of a melter kettle and auxiliary heater of claim 9, further comprising a motor coupled to one of the auger drive shafts to rotate the augers.

11. The combination of a melter kettle and an auxiliary heater of claim 7, wherein the melter kettle include a heat dome chamber in the bottom of melter kettle.

12. The combination of a melter kettle and an auxiliary heater of claim 11, wherein the melter kettle includes an exhaust gas conduit that is provided between the top of the heat dome chamber and the top of the melter kettle through which exhaust gas conduit combustion gases received in the heat dome chamber can be exhausted from the top of the melter kettle.

13. A method of melting a thermoplastic material in a melter kettle having a combustion chamber, said method comprising: charging thermoplastic material into the melter kettle; combusting a fuel source in the combustion chamber to heat and melt the thermoplastic material in the melter kettle; providing an auxiliary heater, said auxiliary heater being coupled outward on an outer side wall of the melter kettle; transporting molten thermoplastic material from the bottom of the melter kettle through the auxiliary heater and then into the top of the melter kettle.

14. A method of melting a thermoplastic material in a melter kettle according to claim 13, further comprising exhausting combustion gases from a top of the heat dome chamber to a top of the melter kettle through an exhaust conduit.

15. A method of melting a thermoplastic material in a melter kettle according to claim 13, wherein the molten thermoplastic material is transported through the auxiliary heater by a series of augers.

16. A method of melting a thermoplastic material in a melter kettle according to claim 13, wherein the auxiliary heater comprises an oil bath chamber through which heated oil is recirculated.

17. A method of melting a thermoplastic material in a melter kettle according to claim 13, wherein the molten thermoplastic material is applied as a pavement maker.

* * * * *